US008549784B2

(12) United States Patent
Evans-Hendrick

(10) Patent No.: US 8,549,784 B2
(45) Date of Patent: Oct. 8, 2013

(54) BAYONET

(75) Inventor: Andrew James Evans-Hendrick, Suffolk (GB)

(73) Assignee: Riflecraft Limited, Norfolk (GB)

( * ) Notice: Subject to any disclaimer, the term of this patent is extended or adjusted under 35 U.S.C. 154(b) by 250 days.

(21) Appl. No.: 13/217,805

(22) Filed: Aug. 25, 2011

(65) Prior Publication Data

US 2012/0079753 A1 Apr. 5, 2012

(51) Int. Cl.
*F41C 27/18* (2006.01)

(52) U.S. Cl.
USPC ..... 42/86

(58) Field of Classification Search
USPC ..... 42/86, 90
See application file for complete search history.

(56) References Cited

U.S. PATENT DOCUMENTS

| | | | | | |
|---|---|---|---|---|---|
| 54,728 | A | * | 5/1866 | Howard | 42/86 |
| 125,720 | A | * | 4/1872 | Chillingworth et al. | 42/86 |
| 143,495 | A | * | 10/1873 | Burton | 30/296.1 |
| 212,244 | A | * | 2/1879 | Lyford | 42/86 |
| 655,577 | A | * | 8/1900 | Pell et al. | 42/90 |
| 813,677 | A | * | 2/1906 | Stillwell | 42/86 |
| 1,002,115 | A | * | 8/1911 | Barnes | 42/86 |
| 1,211,779 | A | * | 1/1917 | Steinmetz | 42/90 |
| 2,333,379 | A | * | 11/1943 | Johnson, Jr. | 42/86 |
| 3,657,835 | A | * | 4/1972 | Musgrave | 42/90 |
| 3,879,878 | A | * | 4/1975 | Musgrave | 42/90 |
| 3,913,252 | A | * | 10/1975 | Musgrave | 42/90 |
| 3,950,878 | A | * | 4/1976 | Musgrave | 42/90 |
| D298,644 | S | * | 11/1988 | Newman et al. | D22/118 |
| 4,821,356 | A | * | 4/1989 | Finn | 42/86 |
| 6,209,250 | B1 | * | 4/2001 | Mills | 42/53 |
| 6,725,593 | B1 | * | 4/2004 | Harris | 42/86 |
| D527,788 | S | * | 9/2006 | Kellgren | D22/118 |
| 7,921,567 | B2 | * | 4/2011 | Trbovich, Jr. | 42/86 |
| 2003/0159220 | A1 | | 8/2003 | Trbovich, Jr. et al. | |
| 2004/0079017 | A1 | * | 4/2004 | Harris | 42/86 |

FOREIGN PATENT DOCUMENTS

DE 102005044168 A1 * 3/2007

OTHER PUBLICATIONS

UK Patent Office Search Report dated Jan. 14, 2011.

* cited by examiner

*Primary Examiner* — Jonathan C Weber
(74) *Attorney, Agent, or Firm* — Andrus, Sceales, Starke & Sawall, LLP

(57) ABSTRACT

This invention provides a bayonet (10) comprising an attachment portion (12) having a first opening (16) for receiving the muzzle of a gun. A second opening is also provided that is aligned with the first opening to allow the passage of a bullet therethrough. An extension portion (14) extends from the attachment portion in the opposite direction of the gun barrel and terminates in a point (24). The attachment portion (12) substantially comprises a polymer and the extension portion (14) has a non ferrous structural core substantially overmolded with a polymer.

23 Claims, 7 Drawing Sheets

SECTION A-A

SECTION A-A

BAYONET

CROSS-REFERENCE TO RELATED APPLICATIONS

This application claims priority of GB Patent Application 1015453.2, filed Oct. 5, 2010, which is incorporated by reference.

TECHNICAL FIELD

The present invention relates to a bayonet for a gun barrel.

BACKGROUND

Bayonets have been used for many years and typically comprise a removable blade or spike attached to the muzzle of a gun barrel. Many bayonets have a handle and are attached to the muzzle by the handle. When removed, the bayonet can then be used as a hand weapon.

The handle of some bayonets fixes to the side of the muzzle and the handle of some bayonets is hollow and fixes over the end of the muzzle so that a bullet fired from the gun passes through the centre of the handle, in these designs the blade or spike is offset from the centreline of the handle.

As well as being used as a close range weapon bayonets are also used as a general tool, for example they are used for digging to identify devices, for example improvised explosive devices (IED's) hidden below the ground surface.

Existing bayonets are generally substantially made of a steel and as such, not only are they quite heavy, which with the increasing amount of equipment soldiers are required to carry in theatre is in itself problematic, but also, being ferrous, they may trigger IED's that have magnetic arming/firing switches.

It is the purpose of the present invention to provide an improved bayonet that meets the demands of modern combat.

SUMMARY

According to the invention there is provided a bayonet comprising an attachment portion having a first opening therein for receiving the muzzle of a gun and a second opening, aligned with the first opening to allow the passage of a bullet therethrough, and an extension portion extending from the attachment portion and terminating in a point wherein the attachment portion substantially comprises a polymer and the extension portion comprises a non ferrous structural core substantially over-moulded with a polymer.

Preferably a tip section of the non ferrous core terminating in said point is exposed. N this manner, when the bayonet is being used in close combat the penetrating tip of the bayonet is not over-moulded with the polymer and accordingly the penetrating tip is part of the structural core.

The exposed tip section comprises a tapered portion that tapers to said point and a parallel portion that extends from the tapered portion towards the attachment portion.

By extending the tip parallel to the over-moulded part for a distance the join line between the exposed part of the core and the over-moulded part of the core does not coincide with the sides or the end of the tapered portion, i.e. as the bayonet enters a body the opening has already been made and there is only a small amount of axial force on the surface of the bayonet as continued movement of the bayonet causes the join line enters the body.

The non ferrous core may extend into the attachment portion.

The non ferrous core preferably comprises said tip section and a shaft section, said shaft section extending from the tip section along the length of the extension section and preferably into said attachment section.

The tip section and the shaft section are preferably unitary but, alternatively, the two parts could be made separately and attached to one another prior to over-moulding, for example by screwing them together. Where the parts are screwed together the tip portion preferably has an anti rotation feature that extends into the over-moulded polymer that prevents rotation of the tip once the polymer has been over-moulded onto the core.

The over-moulded part of the extension section may have the same cross section as the parallel portion of the tip section along its length.

In one embodiment the tapered portion is a polygonal based pyramid. Preferably in this embodiment the parallel portion of the tip section is a prism having the same cross section as the base of the pyramid. More preferably the over-moulded part of the extension section is substantially in the shape of a prism having the same cross section as the parallel portion of the tip section and the base of the pyramid.

In an alternative embodiment the tapered portion is a conical. Preferably in this embodiment the parallel portion of the tip section is a cylinder having the same cross section as the base of the cone. More preferably the over-moulded part of the extension section is substantially in the shape of an elongate cylinder having the same cross section as the parallel portion of the tip section and the base of the cone.

In preferred arrangement the shaft section is cruciform in cross section along at least part of its length. The shaft section may also be substantially planar along at least part of its length. The shape of the shaft section therefore assists in preventing rotation of the shaft within the over-moulded polymer.

In an alternative arrangement the shaft section is substantially circular in cross section. By having a circular cross section the insert can be more economically manufactured.

In a preferred embodiment the non ferrous section comprises an extension that projects from the over-moulded part substantially along the axis of the extension section and in the opposite direction thereof. Preferably said extension is tapered. In this embodiment when the bayonet is removed from the muzzle and used as a hand weapon by holding the attachment portion, as well as the main blade/spike extending to one side of the attachment portion a small spike extends in the opposite direction that can be used for shallow penetrative stabs, for example the short spike may be driven downwards in a striking blow to penetrate the skull into the brain and thereby stun an enemy combatant or terrorist.

The non ferrous core of the bayonet is preferably metallic, more preferably the non ferrous core is titanium.

Alternatively the non ferrous core may be a ceramic.

The attachment portion and the over-moulded portion are preferably made of a glass filled polymer, more preferably a glass filed nylon.

The extension portion can be provided with channels recessed into and extending axially along the surface thereof. Alternatively, or in addition, the extension portion may be covered with a low friction material. As a bayonet penetrates a body a suction is created thereon by the body. The channels or low friction coating assist in the quick and easy removal of the bayonet after it has been used.

BRIEF DESCRIPTION OF THE DRAWINGS

The invention will now be described, by way of example, with reference to the following drawings in which.

DETAILED DESCRIPTION OF PREFERRED EMBODIMENTS

Figure 1:
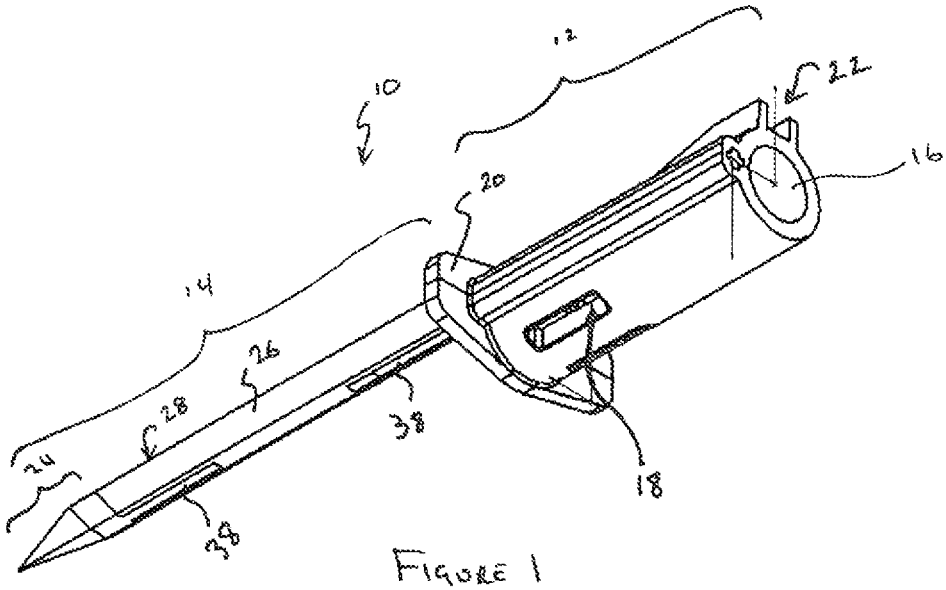
FIG. 1 shows a perspective view of one design of bayonet in accordance with the invention.
Figure 2:
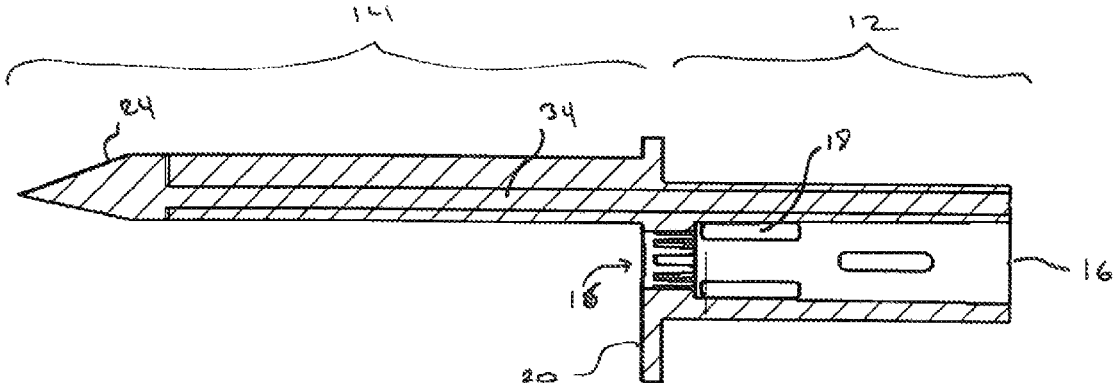
FIG. 2 shows a longitudinal cross section through the bayonet of FIG. 1.
Figure 3:
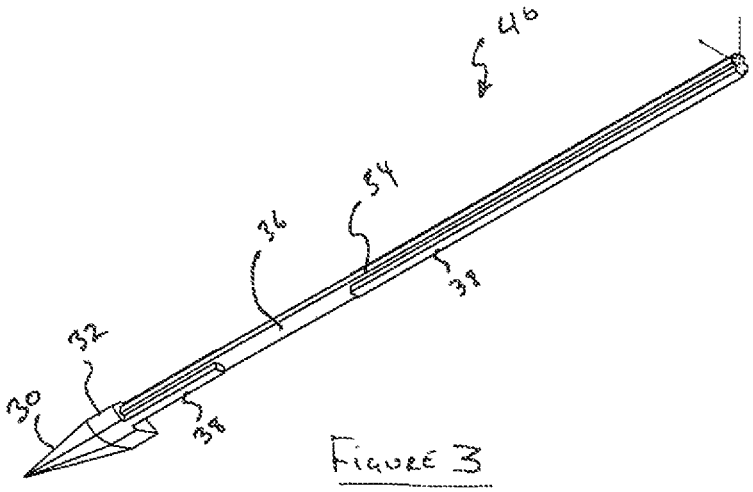
FIG. 3 shows a perspective view of the structural core of the bayonet of FIG. 1.

Referring to FIGS. 1 to 3 a first embodiment of the invention is shown that has a substantially blade like extension. The bayonet 10 comprises an attachment portion 12 and an extension portion 14. The attachment portion 12 serves the dual function of attaching the bayonet to the muzzle of a gun and also acts as a handle for the bayonet 10 when it is removed from the gun and used as a hand held weapon.

The attachment portion 12 has a through hole 16 into which the muzzle of a gun is inserted, the through hole having a stepped profile to limit the insertion of the muzzle into the hole 16. When the gun is fired the bullet exits the muzzle and passes through the opening at the other end of the through hole 16.

The attachment portion 12 has a plurality of openings 18 that, in use, align with suppressor holes in the muzzle of the rifle and allow for the escape of expanding gasses of muzzle flash.

The attachment portion terminates at its forward end in a cross guard 20 which has one end of the through hole 16 therein.

The attachment portion 12 also has attachment means 22 by which the bayonet can be fixed to the gun. The attachment means 22 is of the type well known for use with existing bayonets for standard assault weapons.

The extension portion 14 extends from the cross guard 20 substantially parallel to the through hole 16 and comprises a blade like structure off set from the through hole axis such that there is no interference between a bullet exiting the gun via the through hole 16 and the extension portion.

The extension portion 14 essentially forms the blade of the bayonet and, as well as being useful as a weapon the bayonet may be used for other purposes, e.g. probing into the ground to search for buried objects, The extension portion has a titanium tip 24 that is exposed and a shaft 26 that is made of a glass filled nylon. The titanium tip 24 has a tapered section that is substantially in the shape of a hexagonal based pyramid 30 and a parallel section 32 that extends from the base of the hexagonal based pyramid 30 in the direction of the attachment portion and is in the shape of a hexagonal prism. The hexagonal base of the pyramid 30 is flattened so that it is longer in one axis substantially forming a blade with a sharp edge 28.

The main part of the extension portion 14 comprises a glass filled nylon body having a titanium core 34 passing therethrough. The titanium core is substantially cruciform in shape along its length and has at least one section 36 which is substantially planar in shape. The sides 38 of the cruciform section may be exposed as outer surfaces of the extension portion 14 as shown and the planar section is fully encapsulated within the glass filled nylon. Alternatively the entire cruciform section may be encapsulated. The cruciform shape is beneficial in that it prevents rotation of the structural core 40, which comprises the tip section 24 and the core 34, within the glass filled nylon of the remainder of the extension portion 14.

The core 24 extends through the cross guard 20 and continues along the length of the attachment section 12. The part of the core extending along the attachment section 12 is encapsulated within the glass filled nylon so that it is securely fixed in place.

The glass filled nylon extends up to, and is substantially flush with, the parallel section 32 of the tip 24. As the join between the titanium and the glass filled nylon is in the parallel portion of the bayonet, when the bayonet penetrates an object the penetrative forces are experienced on the tip 24 and as the join line of the tip section 24 and the glass filled nylon passes into the object there is relatively little force acting on the join line.

Referring to FIGS. 3 to 6 an alternative design of bayonet 10*a* is shown that is substantially similar in design to that shown in FIGS. 1 to 3 except in so far as the extension portion 14*a* is substantially circular in cross section.

The extension section 14*a* comprises a tip section 42 comprising a conical part 44 and a cylindrical part 46. The tip section 42 is made of titanium and is exposed. Extending from the tip in the direction of the attachment portion 12 is a core 48 that is circular in cross section. The core 48 extends through the cross guard 20 and extends parallel to the central hole 16 of the attachment section 12. The core 48 is enclosed in glass filled nylon. At the end of the core 48 opposite the tip section 42 is a back extension 50 that is of a greater diameter than the core 48. The back extension is exposed and is substantially flush with the over moulded part of the core section. The back extension provides axial strength and resists the core 48 and tip 42 from being pulled from the bayonet when it is extracted from an object that it has impaled.

It will be appreciated by the skilled person that the shape of the core 34, 48 of the two embodiments are interchangeable with the tip designs so that the core 34 having the cruciform cross section may be used with the conical tip section 42 and the core 48 having the circular cross section may be used with the pyramid shaped tip section 24.

The structural core of the bayonet which comprises the tip section, the core and, where applicable the back extension are preferably manufactured from a single piece of titanium and are therefore integral. However it will be appreciated that the structural core may comprise a number of parts that are connected together, for example by screwing. Where this is the case the tips section and the core will preferably be provided with location features that when over-moulded with the glass filled nylon are prevented from rotating relative to one another.

Figure 4:
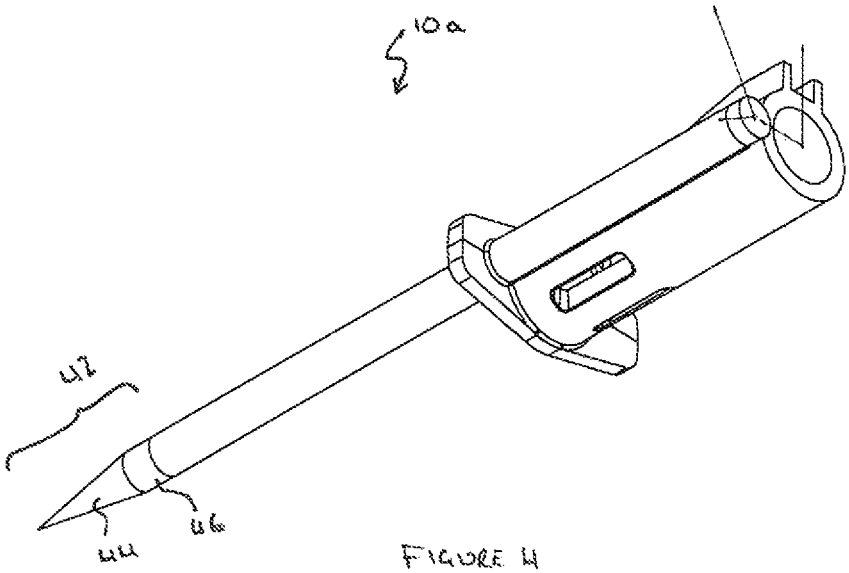
FIG. 4 shows a perspective view of a second design of bayonet in accordance with the invention.
Figure 5:
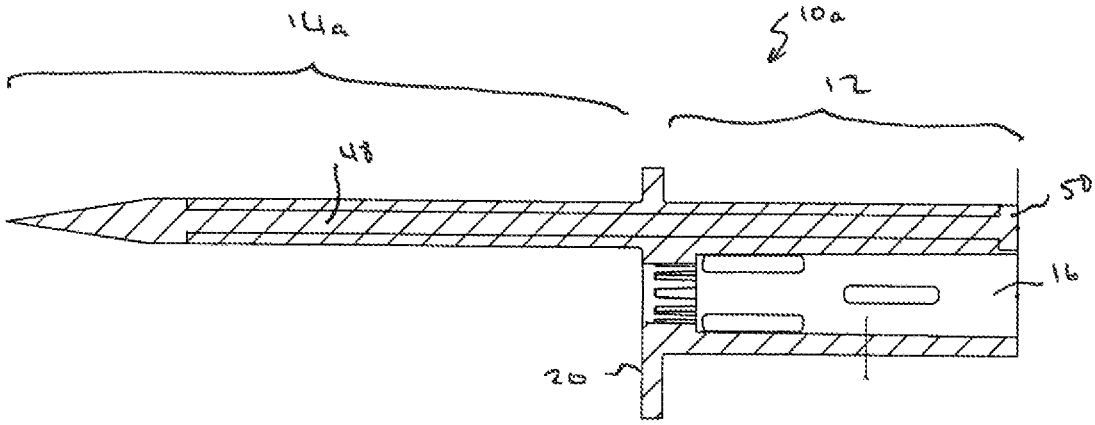
FIG. 5 shows a longitudinal cross section through the bayonet of FIG. 4.
Figure 6:
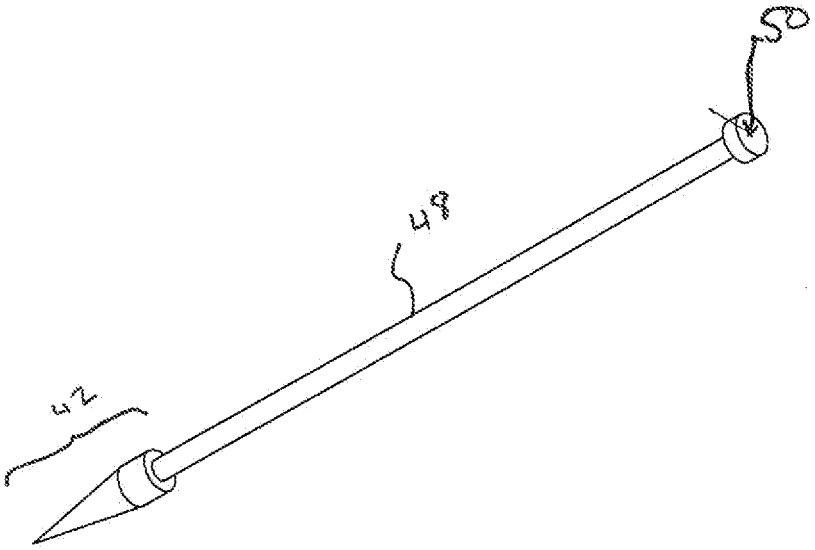
FIG. 6 shows a perspective view of the structural core of the bayonet of FIG. 4.
Figure 7:
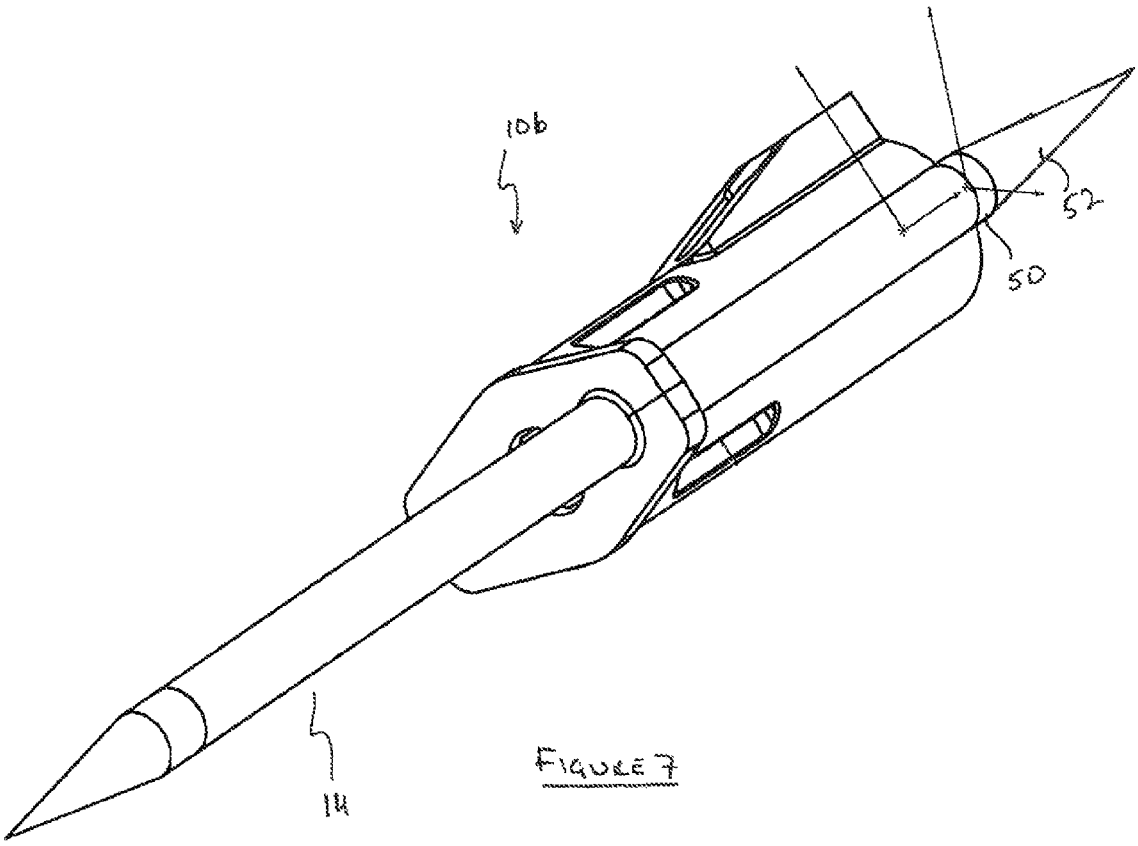
FIG. 7 shows a perspective view of a third design of bayonet in accordance with the invention.

Referring to FIG. 7 an alternative version of the bayonet 10*b* is shown which is substantially the same as that shown in FIGS. 4 to 6 except tin so far as the bayonet 10*b* is provided with a spiked extension 52 that extends from the back extension 50 in a direction away from the extension portion 14. When the bayonet 10*b* is removed from a rifle and is used as a hand held weapon this spike 52 forms an alternative striking weapon that may, for example, be used to puncture the skull. Alternatively it may form a useful tool that may perform a multitude of tasks. The spiked extension 52 is also made of titanium and forms a continuous part of the structural core. Preferably the spiked extension 52 is integrally formed with the core but, as described above, it may be a separate part that is attached to the remainder of the core prior to over-moulding.

All of the bayonets are made in the same manner, namely that the structural core (the core 34, 48, the tip 24, 44 and where appropriate the rear extension 50 and the spiked extension 52) is located in a mould cavity and the glass filled resin that comprises the remainder of the bayonet is added to the mould cavity thereby over-moulding the core and at least partially encapsulating the core.

The bayonets of the invention may be provided with channels that extend along the length of the extension section 14, 14*a* in the surface thereof and/or may be coated with a low friction material so that when the bayonet has been thrust into an object, in particular a body, the bayonet can be easily withdrawn therefrom. As bodies create a suction force this can otherwise make it hard to quickly and easily remove the bayonet.

The resultant bayonet 10, 10*a*, 10*b* is a very strong and robust item that is significantly lighter than a standard bayonet. In addition the bayonet is made entirely of a non ferrous material. This means that soldiers can use the tip of the bayonet for probing for IED's or other buried explosives without fear that the material of the bayonet will set of any magnetically activated switches or triggers.

The invention claimed is:

1. A bayonet comprising an attachment portion having a first opening therein for receiving the muzzle of a gun and a second opening, aligned with the first opening to allow the passage of a bullet therethrough, and a bayonet extension portion extending from the attachment portion parallel to the axes of the first and second openings away from the first opening and terminating in a point wherein the attachment portion substantially comprises a polymer and the bayonet extension portion comprises a non ferrous structural core substantially over-moulded with a polymer.

2. A bayonet according to claim 1 wherein a tip section of the non ferrous core terminating in said point is exposed.

3. A bayonet according to claim 2 wherein the exposed tip section comprises a tapered portion that tapers to said point and a parallel portion that extends from the tapered portion towards the attachment portion.

4. A bayonet according to claim 3 wherein the over-moulded part of the bayonet extension portion has the same cross section as the parallel portion of the tip section.

5. A bayonet according to claim 4 wherein the tapered portion is a polygonal based pyramid.

6. A bayonet according to claim 1 wherein the non ferrous core extends into the attachment portion.

7. A bayonet according to claim 1 wherein the non ferrous core comprises a tip section and a shaft section, said shaft section extending from the tip section along the length of the bayonet extension portion and into said attachment portion.

8. A bayonet according to claim 7 wherein said tip section and said shaft section are unitary.

9. A bayonet according to claim 7 wherein the tip section is conical.

10. A bayonet according to claim 9 wherein the over-moulded part of the bayonet extension portion is substantially cylindrical.

11. A bayonet according to claim 7 wherein said shaft section is cruciform in cross section along at least part of its length.

12. A bayonet according to claim 11 wherein said shaft section is substantially planar along at least part of its length.

13. A bayonet according to claim 7 wherein said shaft section is substantially circular in cross section.

14. A bayonet according to claim 1 wherein the over-moulded part of the bayonet extension portion is substantially in the shape of a prism having a polygonal cross section.

15. A bayonet according to claim 1 wherein the non ferrous structural core comprises a second extension that projects from the over-moulded part substantially along the axis of the bayonet extension section and in the opposite direction thereof.

16. A bayonet according to claim 15 wherein said second extension is tapered.

17. A bayonet according to claim 1 wherein the non ferrous core is metallic.

18. A bayonet according to claim 17 wherein the non ferrous core is titanium.

19. A bayonet according claim 1 wherein the non ferrous core is ceramic.

20. A bayonet according claim 1 wherein the attachment portion and the over-moulded portion are made of a glass filled polymer.

21. A bayonet according to claim 20 wherein the polymer is nylon.

22. A bayonet according to claim 1 wherein the bayonet extension portion has channels recessed into and extending axially along the surface thereof.

23. A bayonet according to claim 1 wherein the bayonet extension portion is coated in a low friction material.

* * * * *